United States Patent [19]

Bengsch

[11] Patent Number: 4,863,078

[45] Date of Patent: Sep. 5, 1989

[54] CLOTHES HANGER

[76] Inventor: Peter Bengsch, Mosseveien 152, Oslo 11, Norway

[21] Appl. No.: 206,536

[22] Filed: Jun. 14, 1988

[30] Foreign Application Priority Data

Jun. 23, 1987 [NO] Norway ..... 872622

[51] Int. Cl.[4] ..... A47G 25/32; A47G 25/38

[52] U.S. Cl. ..... 223/85; 223/DIG. 4; 223/92; 40/322; 24/230.5 R; 248/339

[58] Field of Search ..... 223/85, DIG. 4, 92; 40/322; 211/113, 119.01; 248/339, 340; 24/230.5 R

[56] References Cited

U.S. PATENT DOCUMENTS

| | | | |
|---|---|---|---|
| 2,556,461 | 6/1951 | Baron | 223/85 X |
| 2,671,938 | 3/1954 | Roberts | 223/85 X |
| 2,701,082 | 2/1955 | Cohen | 223/85 |
| 3,048,311 | 8/1962 | Neuenfeldt | 211/119 X |

FOREIGN PATENT DOCUMENTS

| | | | |
|---|---|---|---|
| 2922770 | 12/1980 | Fed. Rep. of Germany | 223/85 |
| 2345126 | 10/1977 | France | 223/DIG. 4 |
| 463738 | 11/1968 | Switzerland | 223/DIG. 4 |

*Primary Examiner*—Robert R. Mackey
*Attorney, Agent, or Firm*—Jordan and Hamburg

[57] ABSTRACT

A clothes hanger with a suspension hook, where a continuous slot, lying essentially in the plane of the hook, is situated in the area of the top of the curve of the suspension hook. A rod is pivotably mounted in this slot in such a fashion that its free end can swing between two terminal positions, in which it extends below or above the curve of the hook.

16 Claims, 2 Drawing Sheets

CLOTHES HANGER

FIELD OF THE INVENTION

The invention relates to a suspension hook and to a clothes hanger having a suspension hook.

Such clothes hangers are generally used in conjunction with a clothes rail in a closet, a fixed hook, or rails in a wardrobe or similar facilities. But frequently one would like to use a clothes hanger for ventilating or drying clothes on a clothesline in the open air. So that the hanger will not slide back and forth on the line, it must be especially fastened to the line, and usually clothespins are used for this. But this entails a series of difficulties. First of all, one must have clothespins available if one wishes to hang clothes hangers in this fashion, and furthermore, the securing action attainable thereby, which would reliably prevent sliding when the article of clothes is swinging, is not reliable enough in actual practice, since the hanger can easily be moved along the line, although it is equipped with a clothespin.

SUMMARY OF THE INVENTION

The invention is therefore based on the aim of designing a clothes hanger in such a fashion that its hook is secured against sliding on the clothesline, without the need of further auxiliary means.

To achieve this aim, the invention provides for a continuous slot essentially in the area of the top of the curvature of the suspension hook, where this slot lies essentially in the plane of the hook. A rod is pivotably mounted in this slot, in such a fashion that its free end can be swung between two terminal positions, in which it extends below and respectively above the curve of the hook.

The effect of the inventive design is the following. When the rod extends below the curve of the hook, the line can be twisted in S-shape between the adjacent parts of the curved hook and the rod, thus achieving a clamping effect. This effect prevents both sliding in the lengthwise direction of the clothesline, and also prevents the hanger from falling down when the clothes swing strongly about the clothesline as axis.

These two safety features are greatly improved even more in the inventive design when the rod has a broadened top plate, situated at the free end of the rod, and lying in the swinging plane.

This top plate naturally is less thick than the width of the slot, since otherwise it could not swing through. It prevents not only a simple spontaneous unhooking of the clothes hanger by an upward impact motion, but also, by an appropriately strong swinging to one or the other end of the clothes hanger, also causes a jamming of the clothesline, so that it achieves even stronger security against sliding in the lengthwise direction of the clothesline.

Furthermore, this top plate affords the possibility of using it as an additional labeling tab or of affixing such a tab on it. For example, in stores this could create an easy and clear labeling of various sizes of clothes, so that tone can tell at a glance the size of the article of clothing that is suspended from such a hanger.

The use of the inventive securing rod is especially simple, if as may be provided in a further development of the invention, the mounting end of the rod has two diametrically opposite mounting pins for snapping into recesses in the walls of the slot. The recesses can most simply be formed by transverse borings. As a result of this design, the rod, with a top plate preferably disposed at its free end, can very simply be inserted into the slot of the suspension hook and can also be withdrawn again by an appropriate pull. Thus it is very simple to exchange a rod with a top plate that bears a certain clothing size against a corresponding component with another size. Naturally, the pins and the recesses can also be disposed inversely on the clothes hanger or suspension hook, but the arrangement described above, with the mounting pin on the rod, is the simplest solution in terms of fabrication.

Another advantageous possible development of the invention consists of designing the suspension hook in such a way that it can be attached in an impermanent fashion since, the special design of the hook then really needs to be used only when the clothes hanger is to be employed for the above purposes. This is advantageous because this special design naturally requires greater construction expenditure than a hook designed without a securing rod. In this way, one avoids more expensive forms for the total clothes hanger, once with and once without the securing pin with the slot in the suspension hook. The manufacturer or the merchant need only replace the suspension hook.

Furthermore, the feature that the suspension hook is attached impermanently also has the advantage that the suspension hook additionally can be pivotably hinged at the clothes hanger. Besides the suspension hook pivoting in the hook plane, which facilitates more compact packing when the clothes hanger is taken along in a suitcase (constant removal can impair the strength of the suspension), the suspension hook here can also be made pivotable about the axis of the attachment arm. Thus, the clothes hanger can swing in the wind without the suspension hook turning at the same time.

In connection with this last development, where the suspension hook can turn about the axis of the attachment arm, one can finally design the attachment arm of the suspension hook as a sleeve that can snap onto a pin of the hook part, with mutually engaging annular grooves or circumferential ribs.

Other advantages, features, and details of the invention can be found in the subsequent description of an embodiment as well as by way of the following drawings.

DESCRIPTION OF THE PREFERRED EMBODIMENTS

Figure 1:
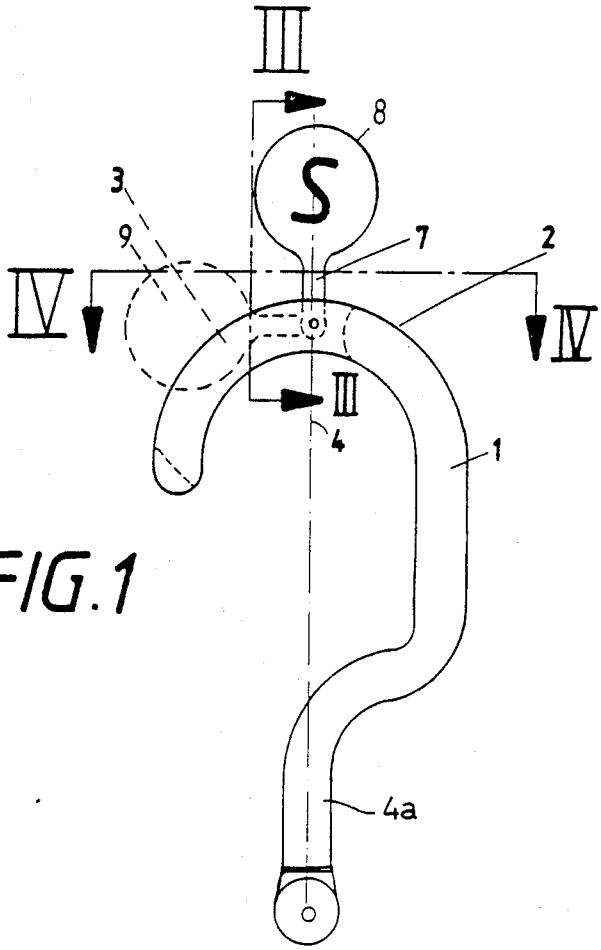
FIG. 1 shows an embodiment of the inventive suspension hook, which is to be fastened impermanently at a (not shown) clothes hanger, with an upwardly swung-out securing rod functioning as a signaling tab.
Figure 3:
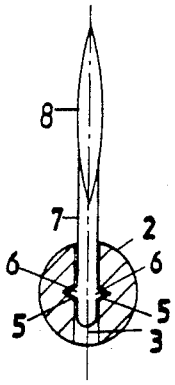
FIG. 3 shows an enlarged section along the line III—III in FIG. 1.
Figure 4:
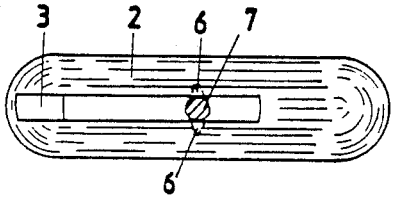
FIG. 4 shows an enlarged section taken along the line IV—IV in FIG. 1.
Figure 2:
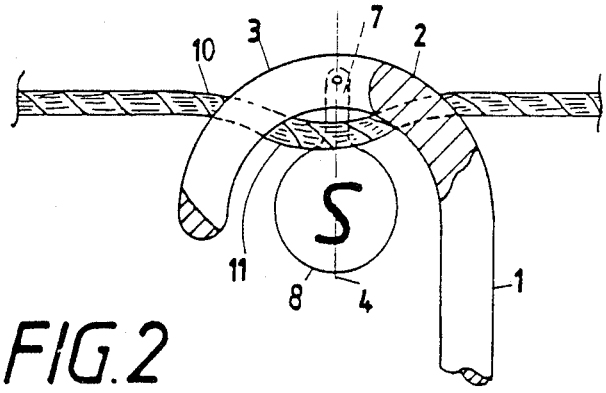
FIG. 2 shows a partial view of the suspension hook in the suspension position on a clothesline with the rod swung downwards in the suspension securing position.

FIGS. 1 through 4 show a suspension hook 1 for a clothes hanger. Its lower end can be affixed pivotably at the (not shown) clothes hanger in the plane of the clothes hanger. It can be fastened preferably by snapping in or possibly also by inserting it through an appropriately wide slot in the clothes hanger. But this is in itself well known and thus will not be explained further at this point. The suspension hook 1 has a continuous slot 3 in the area of the hook curve 2. In the area where the axis 4 of the attachment arm 4*a* intersects the hook curve 2, the walls of the slot 3 have recesses 5. The serrations or pins 6, which are disposed at the mounting end of the securing rod 7, engage these recesses. The securing rod 7 is mounted in the slot 3 so as to be rotatable about the pins 6. It can rotate here in such a fashion that the rod—which has a widened-out top plate in the shown embodiment—can swing between the position shown in FIG. 1 with the top plate extending upwardly over the curve, into a position (FIG. 2) in which the rod 7 with the top plate 8 lies below the hook curve 2.

If the clothes hanger is used in the usual manner on a rail in a closet or in a wardrobe, the rod 7 with the top plate 8 is brought into the position that is indicated by solid lines in FIG. 1. Here symbols for the size of the clothing can be attached to the tag. In FIG. 1, one can see the symbol S for "small" on the top plate which extends upward in the manner of a tab. This symbol is currently used quite generally for labeling articles of clothing.

In the intermediate position, indicated by dashed lines in FIG. 1, the securing rod 7 with its top plate 8 cannot cause any interference even with constricted space conditions. Via this intermediate position, the rod 7 can also be swung into the position shown in FIG. 2, which is especially useful in conjunction with suspension on a clothesline. That rearward section of the hook 1, which is away from its free end, is hooked onto the clothesline 10. By pivoting it, such that the clothesline is placed in a bight about the rod 7, it is hooked over the opposite side so that, in this fashion, the hook is securely fastened on the clothesline 10. The security of the fastening can here be increased still further by moving the rod 7 somewhat further to the left or right relative to the position shown in FIG. 2, so that the rope on one side is completely caught between the top plate and the corresponding hook section.

Figure 5:
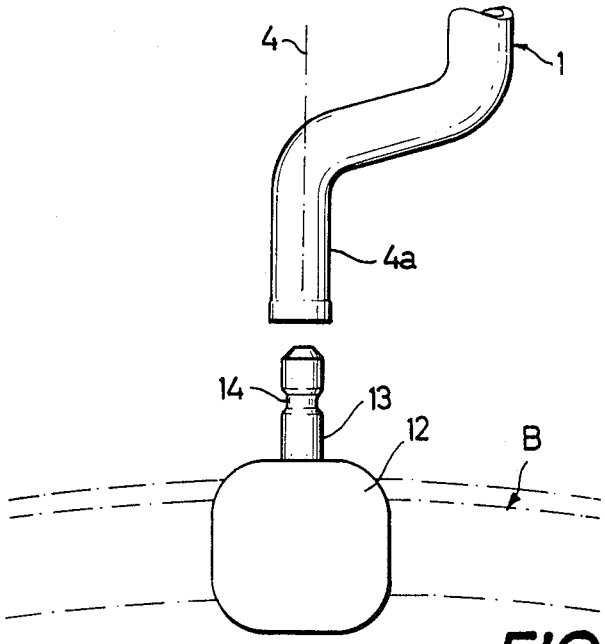
FIG. 5 shows a section of a clothes hanger in an exploded representation, where the suspension hook can be rotatably attached in a pin in the hanger.
Figure 6:
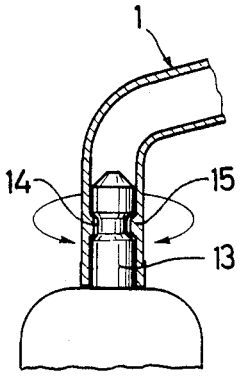
FIG. 6 shows a partially sectioned view of the joining area between the clothes hanger and the suspension hook according to FIG. 5.

FIGS. 5 through 6 show a modified design of the attachment 4*a* of the suspension hook 1, in such a fashion that the suspension hook is fastened at the hoop B (shown only schematically) so as to pivot about the longitudinal axis 4 of its attachment arm 4*a*. An attachment peg 13 with a circumferential annular groove 14 is integrally attached to the plate 12 of the hoop B. The sleeve-shaped end of the attachment arm 4*a* can be snapped into the annular groove 14 by means of a circumferential rib 15 which can snap inwards.

I claim:

1. A suspension hook having a generally inverted U-shaped configuration having two generally downwardly depending legs and a connecting top which connects upper parts of said legs, means defining a slot in said hook extending generally in the plane of said hook, said slot extending into said connecting top and into one of said legs, pivot means located at said connecting top within said slot, and rod means pivotably supported by said pivot means for pivotable movement between a lower position disposed below said connecting top and an upper position above said connecting top, said rod means passing through said slot upon being pivoted between said two positions.

2. A suspension hook according to claim 1, wherein one of said legs extends further downwardly than the other leg, and further comprising connecting means on said one leg adapted to have connected thereto a clothes hanger support.

3. A suspension hook according to claim 2, wherein said connecting means rotatably supports said clothes hanger support for rotatable movement relative to the suspension hook.

4. A suspension hook according to claim 1, wherein said rod means has a free end formed as a flat portion which extends generally in the plane of the suspension hook.

5. A suspension hook according to claim 1, wherein said slot is defined by two opposed side walls, said pivot means comprising recesses in said side walls, said rod means having projections pivotably mounted in said recesses.

6. A suspension hook according to claim 5, wherein said slot is further defined by two end walls such that the slot has an enclosed outer boundary defined by said two side walls and said two end walls.

7. A suspension hook according to claim 1, wherein said slot and rod means are constructed such that said rod means is non-permanently mounted in said slot and can be manually inserted and removed from said pivot means in said slot so that the suspension hook, can be selectively used with and without the rod means.

8. A suspension hook according to claim 1, wherein said connecting top has a central part substantially midway between said two legs, said pivot means being located at said central part.

9. A suspension hook according to claim 1, wherein said legs and said connecting top have a generally circular cross-sectional configuration, said slot having parallel side walls generally parallel to a diametric line passing through the center of said circular cross-section.

10. A suspension hook according to claim 1, wherein the hook is adapted to be suspended from a suspension line, said rod means when ins aid lower position extending generally downwardly between said two legs such that said hook is adapted to be suspended from said suspension line such that said rod means is looped over said suspension line as the latter passes on one side of both legs and on the opposite side of said rod means, thereby providing security against sliding of the suspension hook along said suspension line.

11. A suspension hook according to claim 1, wherein said rod means has a flat portion, said rod means when in said upper position extending generally vertically upwardly such that said flat portion can serve as a label tag.

12. A clothes hanger comprising a suspension hook having a generally inverted U-shaped configuration having two generally downwardly depending legs and a connecting top which connects upper parts of said legs, means defining a slot in said hook extending generally in the plane of said hook, said slot extending into said connecting top and into one of said legs, pivot means located at said connecting top within said slot, and rod means pivotably supported by said pivot means for pivotable movement between a lower position disposed below said connecting top and an upper position above said connecting top, said rod means passing through said slot upon being pivoted between said two positions, and clothes support means mounted on one of said legs.

13. A clothes hanger according to claim 12, further comprising rotatable means rotatably mounting said clothes-support means on said one leg, said rotatable means having a rotating axis which intersects the pivotal axis about which said rod means pivots.

14. A clothes hanger according to claim 13, wherein said one leg has a sleeve portion, said clothes-support means having a pin portion rotatably supported in said sleeve portion.

15. A clothes hanger according to claim 14, wherein said sleeve portion has annular groove means, said pin portion having circumferential rib means rotatably received in said annular groove means.

16. A clothes hanger according to claim 13, further comprising pivotable means pivotably mounting said clothes-support means on said one leg, said pivotable means having a pivotable axis disposed in a plane which is parallel to a plane containing the pivotal axis about which said rod means pivots.

* * * * *